US005597096A

United States Patent [19]

Jeppesen et al.

[11] Patent Number: 5,597,096

[45] Date of Patent: Jan. 28, 1997

[54] SHAKER FOR CONDIMENTS

[75] Inventors: Hanne D. Jeppesen, Holte; Jakob Heiberg, Charlottenlund; Stig Lillelund, Gentofte, all of Denmark

[73] Assignee: Dart Industries Inc., Orlando, Fla.

[21] Appl. No.: 593,098

[22] Filed: Feb. 15, 1996

[51] Int. Cl.[6] ..... B65D 5/72

[52] U.S. Cl. ..... 222/498; 215/317; 220/281

[58] Field of Search ..... 222/498, 499, 222/505, 544, 556, 562; 215/317, 344, 224; 220/281, 306

[56] References Cited

U.S. PATENT DOCUMENTS

| | | | |
|---|---|---|---|
| D. 318,778 | 8/1991 | Fiore et al. . | |
| 2,218,308 | 10/1940 | Comer | 215/317 X |
| 3,170,588 | 2/1965 | Lyon, Jr. | 220/306 |
| 3,321,114 | 5/1967 | Croyle | 222/499 |
| 3,658,217 | 4/1972 | Collie et al. | 222/498 X |
| 3,782,575 | 1/1974 | Braun | 215/317 X |
| 3,853,237 | 12/1974 | Marchant | 215/317 X |
| 3,934,745 | 1/1976 | Lovell | 220/281 X |
| 4,180,178 | 12/1979 | Turner | 215/317 X |
| 4,187,953 | 2/1980 | Turner | 220/281 X |
| 4,747,518 | 5/1988 | Laauwe | 222/494 X |
| 4,901,892 | 2/1990 | Song | 222/498 |
| 5,273,177 | 12/1993 | Campbell | 222/498 X |

*Primary Examiner*—Kevin P. Shaver
*Attorney, Agent, or Firm*—John A. Doninger

[57] ABSTRACT

A condiment shaker including a vertically elongate base of generally conical configuration and defining an upwardly opening mouth. A separate unitary seal releasably snap-mounts over the mouth and includes hinge-joined lower and upper walls having annular outer portions selectively moveable to expose dispensing openings in the lower wall, and selectively moveable to seal the dispensing openings in the lower wall.

11 Claims, 2 Drawing Sheets

SHAKER FOR CONDIMENTS

BACKGROUND OF THE INVENTION

Condiment shakers, most commonly used for the storing and selective dispensing of salt and pepper, usually comprise a base defining a storage chamber, access means for introducing the condiment in bulk into the chamber, and one or more dispensing openings through which the condiment can be discharged in selected portions.

Condiment shakers, as found in the home, restaurants, and the like, are normally a relatively inexpensive item with little concern paid to the purpose of the shaker other than for the basic utilitarian features of storing and dispensing a condiment. For example, the shaker may be awkward to hold and manipulate, particularly if a large storage chamber is provided. Also, condiments themselves, particularly salt, if not fully protected within the shaker, tend to absorb moisture and clog dispensing openings. Even in those instances wherein some form of protective cover for the openings is provided, the cover is frequently difficult or at least awkward to manipulate.

Thus, it will be recognized that while the conventional salt and pepper shaker is a simple item in everyday use, there is substantial room for improvement.

SUMMARY OF THE INVENTION

The present invention is intended to significantly improve on the conventional shaker and provide a uniquely superior item which is practical, economical, easily manipulated and attractive.

The shaker, made of an appropriate food compatible synthetic resinous material or materials, is formed of only two separately molded components, a base defining an enlarged storage chamber, and a seal. The seal, notwithstanding its unitary molded construction, provides for access to the chamber for bulk introduction of the condiment, and also provides both dispensing openings and movable closure means for selectively sealing and cleaning the openings for a protection of the contents of the shaker.

The base of the shaker is vertically elongate with the major portion of the height thereof being of a truncated conical configuration terminating in an upper portion outwardly flared to define a wide circular mouth area. So configured, an enlarged storage area is provided at the lower end of the formed chamber while the upper portion of the base, immediately below the outwardly flaring upper portion, is provided with a smaller circumference easily encircled by the hand to facilitate holding and manipulation of the shaker during use.

The unitary seal includes an annular lower wall with an outer periphery which is releasably snap-locked to the mouth area of the base for selective removal for bulk loading of the condiment. The seal also includes an upper wall in the nature of a disk completely overlying the lower wall with an outer periphery substantially coextensive with the outer periphery of the lower wall. The upper wall, at a radially intermediate portion thereof, is circumferentially joined to the inner periphery of the lower wall by a continuous living hinge. The upper disk-like wall, in the closed position of the seal, is upwardly convex with the annular portion of the upper wall outward of the living hinge intimately overlying the upper surface of the lower wall. The lower wall in turn has dispensing apertures or openings therethrough which, in the closed position, are sealed by mating protuberances engaged within the holes and depending from the undersurface of the upper wall.

To move the seal to the dispensing position, the central portion of the upper wall is depressed, causing a snap-action movement about the circumferential hinge. This in turn upwardly flips the outer annular portion of the upper wall upwardly away from the lower wall, exposing the dispensing openings. The opening of the seal for dispensing is easily effected by the pressure of a single finger thereon which can be provided in conjunction with a raising of the shaker during normal usage. A similar resealing requires only a similar downward pressure on the outer rim portion of the upper wall.

Further features and advantages of the invention will be noted in the more detailed description of the invention following hereinafter.

DESCRIPTION OF THE PREFERRED EMBODIMENTS

Figure 1:
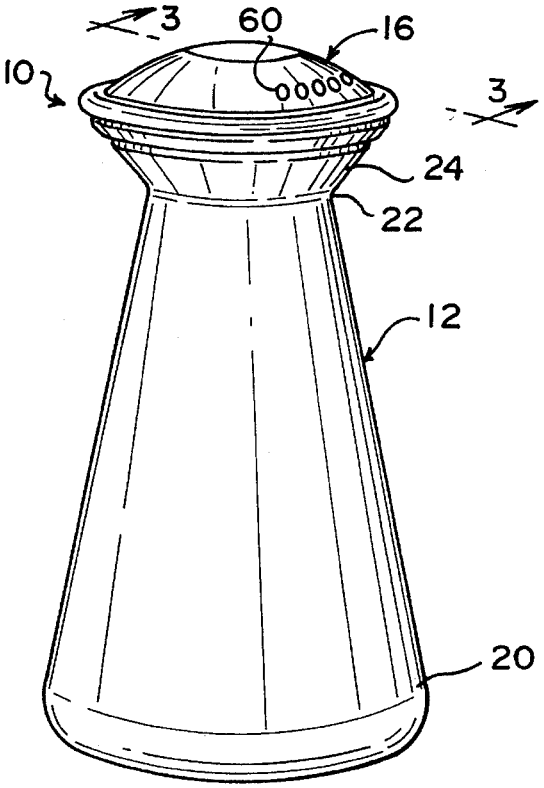
FIG. 1 is a perspective view of the condiment shaker of the invention with the seal closed.

Referring now more specifically to the drawings, the condiment shaker 10 consists of two separately molded components, the base 12, defining an internal storage chamber 14, and the seal 16. Both components are formed of an appropriate food-compatible synthetic resinous material.

The base 12 is generally in the shape of a truncated cone with the peripheral wall 18 tapering upwardly from an enlarged bottom area 20 to a restricted neck area 22 above which is an upward and outwardly flaring upper or head portion 24 defining a circular mouth 26. An integral mounting bead 28 extends outward from the wall 18 circumferentially about the upper mouth-defining rim thereof.

The above-described configuration of the shaker base 12 is considered particularly desirable in that the enlarged bottom portion of the chamber 14 allows for the storage of a relatively large supply of the condiment. In combination therewith, the relatively narrower neck area provides a reduced circumference which is easily grasped within the hand for use of the shaker in the conventional manner. The outwardly flaring head portion, as well as the gradually enlarging base below the neck area also tend to prevent any slippage of the shaker within the hand, even during a rather vigorous manipulation thereof.

The seal 16 includes a lower wall 30 and an upper wall 32. The lower wall 30 includes a circumferential outer edge or rim portion 34 reversely turned to define a radially inward directed annular groove 36 configured to tightly receive the bead 28 of the base 12, snap-locking thereto in a manner as to prevent leakage therebetween and require positive physical pressure for disengagement.

The lower wall 30 is annular, and upwardly convex from the outer periphery to an inner periphery 38. For purposes of relative size, the inner periphery 38 of the annular lower wall 30 defines a diameter approximately two-thirds that of the outer diameter of the lower wall 30.

Figure 5:
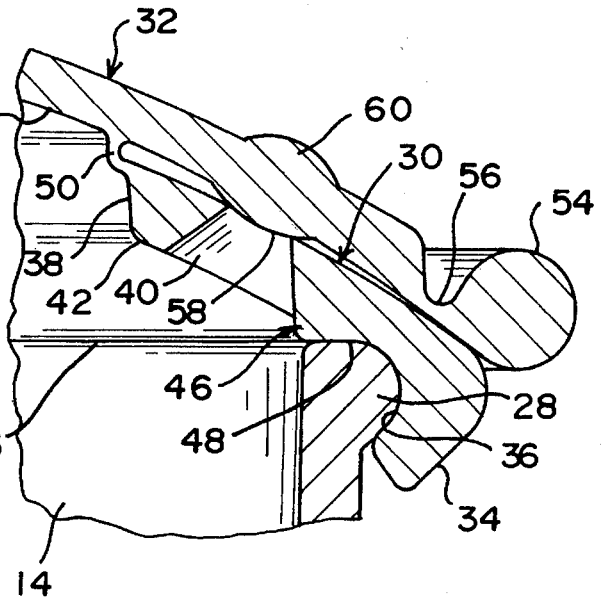
FIG. 5 is an enlarged cross-sectional detail illustrating the outer portion of the seal in the closed position.
Figure 6:
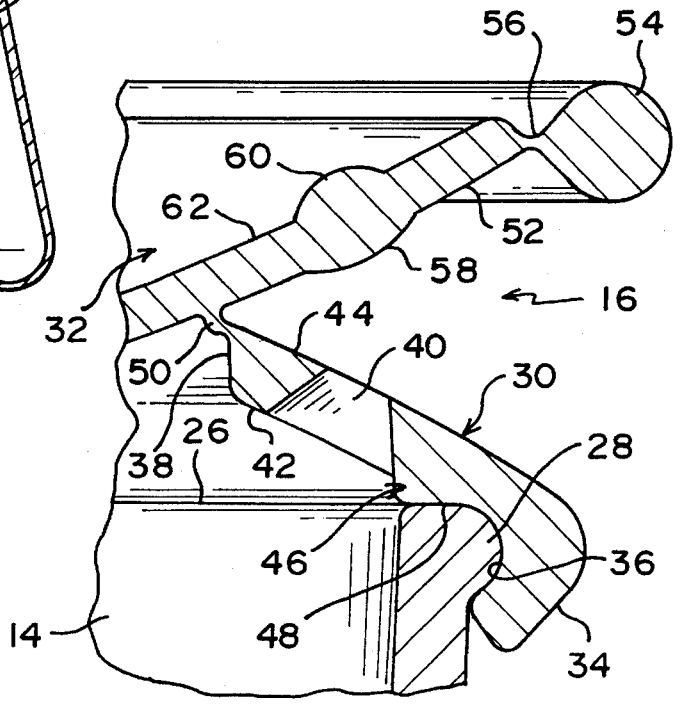
FIG. 6 is an enlarged cross-sectional detail similar to FIG. 5 with the seal in the open dispensing position.

Noting the details of FIGS. 5 and 6, a plurality of dispensing openings 40 are provided through the lower wall 30 along a minor arc of the annular configuration. These openings are slightly conical, tapering from an enlarged open lower end at the inner surface or face 42 to a relatively smaller open end at the outer face or surface 44 of the lower wall 30.

In order to stabilize the lower wall 30 at the interlock between the bead 28 and groove 36, and to also increase the rigidity of the annular wall 30 beyond that inherent in the material thereof, an integral annular enlargement 46 is provided on the inner surface 42 radially outward from the dispensing openings 40. This enlargement 46 forms a planar annular surface 48 extending from the bead-receiving groove 36 and engaging flush on the corresponding planar upper edge surface of the base rim.

The upper wall 32 is in the configuration of a circular domed disk with an outer periphery substantially co-extensive with the outer periphery of the lower annular wall 30.

In the closed position of the seal 16, the upper wall 32 is upwardly convex and, along the outer annular extent thereof, in close overlying contact with the upper surface 44 of the lower wall 30. The lower and upper walls 30 and 32 are integrally joined by a circumferential continuous living hinge 50 formed between the inner periphery 38 of the lower wall and the inner surface 52 of the outer wall 32 along a circumferential line aligned with the inner periphery 38 of the lower wall 30. A stabilizing bead 54 is integrally formed circumferentially about the outer periphery of the upper wall 32 through an intermediate circumferentially continuous living hinge 56 to allow for relative flexture between the periphery bead 54 and the upper wall 32 inward thereof during movement of the upper wall between closed and open positions as shall be described subsequently.

In order to effectively close the dispensing openings 40 in the closed position of the seal, a series of protuberances 58, of a generally bulbous configuration, are formed to depend from the lower surface 52 of the upper wall 32 for sealing engagement in the openings 40 upon a closing of the seal. As will be appreciated, a separate protuberance is provided for engagement in each opening. Noting FIG. 5, the shape of each protuberance 58 is such as to enter slightly into the companion opening 40, sealing completely about the edge thereof and downwardly dislodging any accumulation within the opening. This in turn is facilitated by the downward flaring nature of the openings, thereby providing an effective cleaning action with each closure of the seal.

A similar set of protuberances 60, or other indicia, is provided on the upper surface 62 of the upper wall 32 in alignment with the openings 40 to afford a ready indication of the location of the openings for convenience in pouring. This is particularly desirable as the openings are partially hidden even when the seal is open. Incidentally, with reference to FIGS. 2 and 6, it will be appreciated that, in the open seal, the overlying upper wall 32 provides a guide and barrier for the dispensing condiment, thus avoiding the tendency of the condiment, upon a vigorous shaking, to scatter beyond the preferred bounds as frequently occurs with the conventional salt shaker.

Both the lower and upper walls 30 and 32 of the seal 16 are relatively rigid and of a self-sustaining construction with a degree of inherent flexible resiliency utilized in the mounting of the seal on the base 12 and the selective opening and closing of the seal.

In order to mount the seal 16 to the base 12, the seal, and in particular the peripheral portion of the lower seal wall 30, is aligned over the beaded rim portion about the mouth of the base and downwardly forced to, through an appropriate resilient flexing of the lower wall portion 30 and/or the mouth portion of the base, engage the bead 28 within the annular groove 36 defined by the peripheral portion of the lower wall 30. In order to remove the seal, for a bulk-refilling of the base 12, one need merely grasp the rim portion 34 of the lower wall of the seal and, through a combination of an upward pull and flexing of the engaged components relative to each other, peel the seal from the base.

Figure 2:
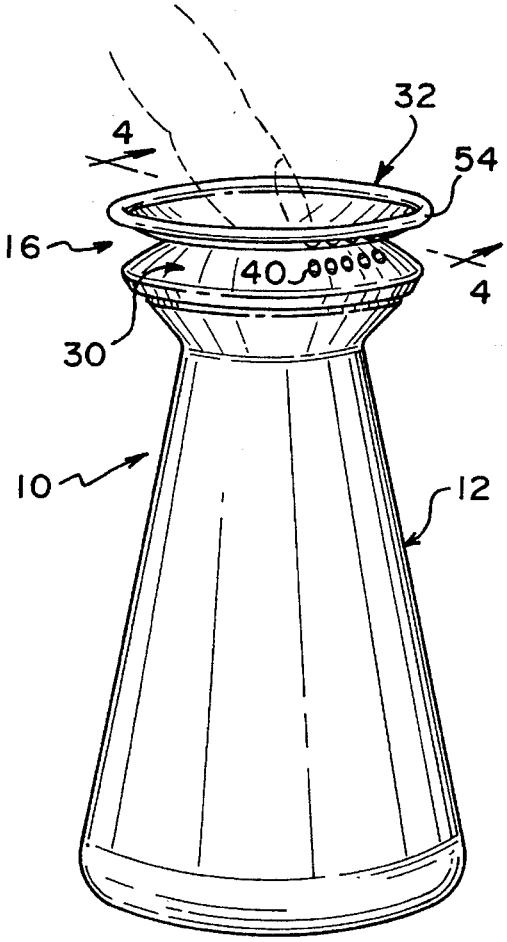
FIG. 2 is a similar perspective view with the seal open and indicating the area of finger pressure required to open the seal.
Figure 3:
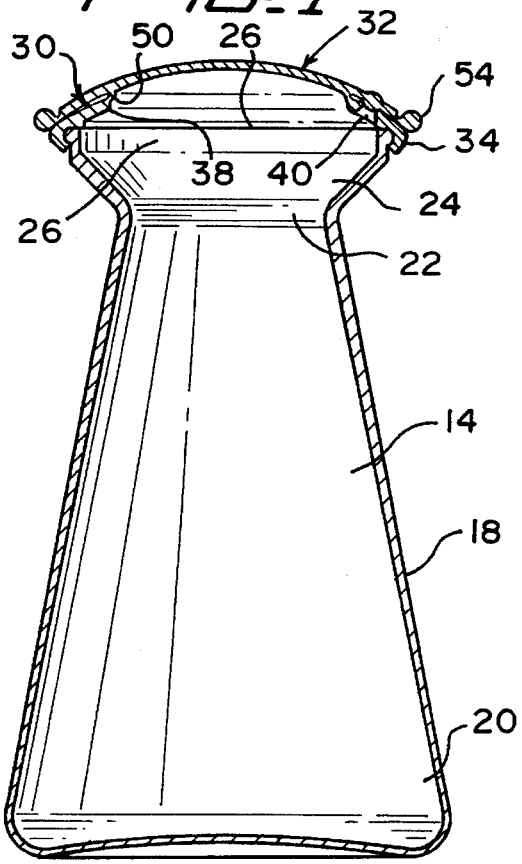
FIG. 3 is a vertical cross-sectional view taken substantially on a plane passing along line 3—3 in FIG. 1.
Figure 4:
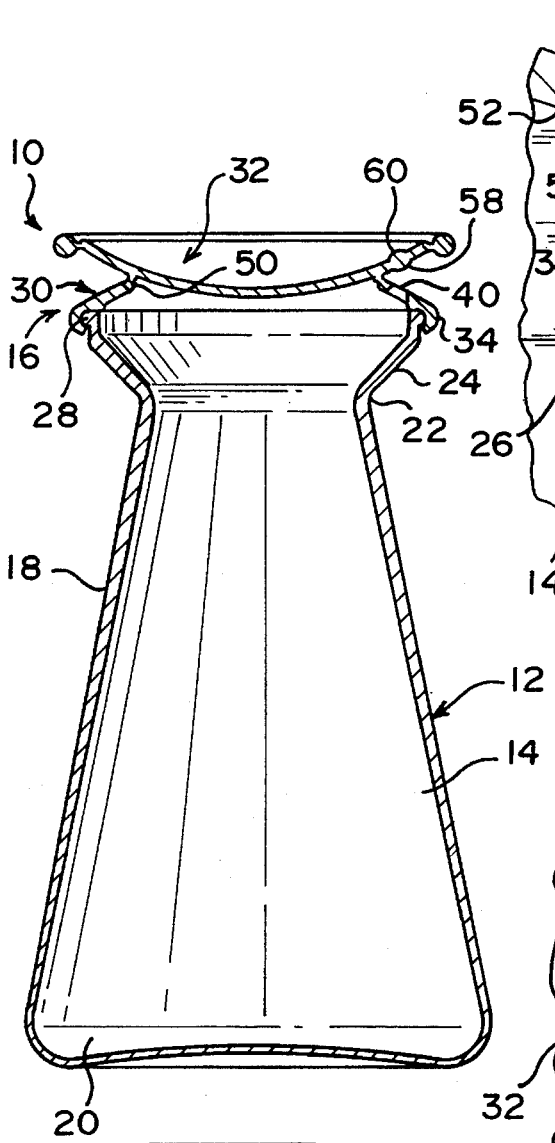
FIG. 4 is a vertical cross-sectional view taken substantially on a plane passing along line 4—4 in FIG. 4.

As previously indicated in the closed position of the seal, the upper wall 32 is upwardly domed or convex and, about the outer peripheral portion thereof outward of the living hinge 50, is rather intimately engaged with the upper surface 44 of the lower wall 30 with the protuberances 58 seating within and sealing the openings 40. With reference to FIG. 2, the seal is opened by the simple expedient of exerting a downward pressure, normally by the finger of a user, on the centrally domed portion within the circular area defined by the living hinge 50. This downward pressure will cause a snap-action inverting of the upper wall 32, the wall moving over-center and assuming an upwardly directed concave configuration where it is self-sustaining until manually returned to the closed position. In the open position, best illustrated in FIGS. 2 and 4, the outer peripheral portion of the upper wall 32 outwardly and upwardly diverges from the lower wall 30 radially outward from the living hinge 50, fully exposing the dispensing openings 40 with the sealing protuberances 58 withdrawn therefrom. As the upper wall 32 pivots about the living hinge 50 to the inverted position, there is an over-center movement of the central domed portion relative to the outer rim 54 whereby the upper wall 32 is inherently retained in the open position thereof. In order to return the upper wall to the closed position, one need merely exert a downward pressure on the outer rim portion 54 of the upper wall until the central domed portion, pivoting about the living hinge 50, snaps upwardly with the annular portion thereof beyond the living hinge 50 engaging against the upper surface of the lower wall 30.

The foregoing is considered illustrative of the principles of the invention, and, notwithstanding the specific illustration of a preferred embodiment, it is to be appreciated that the scope of the invention is only to be limited by the scope of the claims following hereinafter.

We claim:

1. A condiment shaker comprising a chamber-defining base with an upwardly opening mouth for the selective introduction of a condiment in bulk, a seal removeably mounted to said base over said mouth, said seal having a lower wall, said lower wall having an outer peripheral portion releasably engagable with said base peripherally about said mouth for mounting said seal to said base, said lower wall having an inner periphery, said seal further including an upper wall overlying said lower wall, a living hinge integrally formed with the inner periphery of the lower wall and with the upper wall thereabove for a pivotal movement of the upper wall relative to said lower wall, said upper wall including an outer portion outward of said living hinge overlying said lower wall, said upper wall including an inner portion inward of said living hinge, at least one dispensing opening defined through said lower wall, said seal having a closed position wherein said outer portion of said upper wall closely overlies said lower wall in contact therewith and sealing said at least one dispensing opening, said seal having an open position wherein said outer portion of said upper wall upwardly diverges from said lower wall outwardly from said living hinge to expose said at least one dispensing opening.

2. The condiment shaker of claim 1 wherein said upper wall is self-sustaining in each of said closed and open positions, said upper wall moving over-center, relative to said hinge, upon moving from one of said positions to the other of said positions.

3. The condiment shaker of claim 2 wherein said upper wall of said seal, in the closed position of said seal, is upwardly convex, said upper wall being responsive to downward pressure thereon, inward of said living hinge, to pivotally invert about said living hinge and define an upwardly directed concave configuration to expose said at least one dispensing opening.

4. The condiment shaker of claim 3 wherein said upper wall of said seal, in alignment with said at least one dispensing opening, includes at least one downwardly directed protuberance received within said at least one opening in said closed position.

5. The condiment shaker of claim 4 wherein said upper wall has a circular outer periphery defined by a continuous bead with a circumferentially continuous living hinge immediately inward of said bead.

6. The condiment shaker of claim 5 wherein said base includes an upper rim peripheral about said mouth, said rim including an outwardly directed bead continuously therealong, said outer peripheral portion of said lower wall of said seal defining a continuous inwardly directed groove receiving said rim bead, said lower wall, immediately inward of said groove, having an integral inwardly directed enlargement extending continuously about said lower wall for seated engagement on said base rim and stabilization of said lower wall relative to said base.

7. The condiment shaker of claim 6 wherein said base has a lower portion of a generally truncated conical configuration tapering upward from an enlarged bottom portion to a narrower upper neck portion, said base, above said neck portion, outwardly flaring and terminating in said upper rim about said mouth.

8. The condiment shaker of claim 4 wherein said upper wall has an outer surface, and indicia on said outer surface aligned with and indicating the location of said at least one dispensing opening.

9. The condiment shaker of claim 1 wherein said upper wall, in the closed position of said seal, is of a continuous upwardly convex dome configuration, said upper wall being downwardly flexible inward of said circumferential living hinge for movement to said open position, said upper wall, in said open position, being upwardly concave.

10. The condiment shaker of claim 9 wherein said lower wall is annular, said living hinge being continuous about said inner periphery of said lower wall.

11. A condiment shaker comprising a chamber-defining base with an upwardly opening mouth for the selective introduction of a condiment in bulk, a seal removeably mounted to said base over said mouth, said seal having a lower wall, said lower wall having an outer peripheral portion releasably engagable with said base peripherally about said mouth for mounting said seal to said base, said lower wall having a continuous inner periphery, said seal further including an upper wall overlying said lower wall, a continuous living hinge integrally formed with the inner periphery of the lower wall and with the upper wall thereabove for a pivotal movement of the upper wall relative to said lower wall, said upper wall including an outer portion outward of said living hinge overlying said lower wall, said upper wall including an inner portion inward of said living hinge, opening means for dispensing condiment defined through said lower wall, said seal having a closed position wherein said outer portion of said upper wall closely overlies said lower wall in contact therewith and sealing said opening means, said upper wall, in the closed position of said seal, being of a continuous upwardly convex dome configuration, said seal having an open position wherein said outer portion of said upper wall upwardly diverges from said lower wall outwardly from said living hinge to expose said opening means, said upper wall being downwardly flexible inward of said circumferential living hinge for movement to said open position, said upper wall, in said open position, being upwardly concave.

* * * * *